United States Patent [19]

Orien et al.

[11] 3,992,788

[45] Nov. 23, 1976

[54] INSOLE AND OUTSOLE CONSTRUCTION FOR ATHLETIC (TENNIS) SHOES, AND THE LIKE

[76] Inventors: William P. Orien, 8581 W. Pico Blvd., Los Angeles, Calif. 90035; Merton L. Root; John H. Weed, both of 1848 Saratoga Ave., San Jose, Calif. 95129

[22] Filed: July 14, 1975

[21] Appl. No.: 595,848

[52] U.S. Cl. ..... 36/91; 36/71

[51] Int. Cl.[2] ..... A43B 7/22; A43B 19/00

[58] Field of Search ..... 36/2.5 R, 4, 71, 81, 36/28, 32 R, 91

[56] References Cited

UNITED STATES PATENTS

| | | | |
|---|---|---|---|
| 2,086,242 | 7/1937 | Sheridan | 36/71 |
| 2,475,417 | 7/1949 | Wysowski | 36/71 |
| 3,566,486 | 3/1971 | Conway | 36/71 |
| 3,892,077 | 7/1975 | Wolstenhome et al. | 36/71 |

*Primary Examiner*—Patrick D. Lawson
*Attorney, Agent, or Firm*—Keith D. Beecher

[57] ABSTRACT

An insole and outsole construction is provided which is particularly applicable to athletic shoes, but which has general utility in a wide variety of boots and shoes. The insole construction includes three pads formed on its upper surface for engaging the bottom of the foot and which will be designated herein as the tri-plane heel pad, the lateral heel pad and the buttress pad. The outsole construction includes the provision of inserts of relatively dense material directly under the lateral and tri-plane pads. The pads and inserts cooperate to provide adequate stability, particularly to the foot and ankle during violent movements thereof; and to minimize movement of the foot within the shoe, thereby to cut down to a large extent generation of frictional heat. The insole pads also serve to minimize foot elongation and thereby decrease movement of the forefoot and thereby prevent injury to the toes. The outsole inserts tend to inhibit the tendency of the shoe to turn violently with resulting injury during strenuous athletic exercise. The insole pads also serve to stabilize the foot in the shoe with a minimum of muscle activity, resulting in minimizing fatigue.

9 Claims, 7 Drawing Figures

FIG. 6 (BUTTRESS PAD) POSTERIOR SECTION)
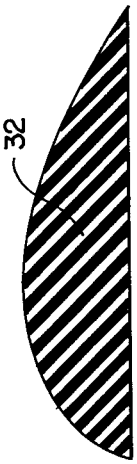
FIG. 5 (LATERAL HEEL PAD) (CROSS SECTION)
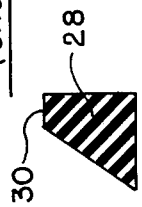
FIG. 7 (BUTTRESS PAD) (MEDIAL SECTION)
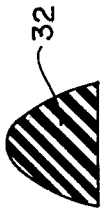
FIG. 3 (TRI-PLANE PAD) (MEDIAL SECTION)
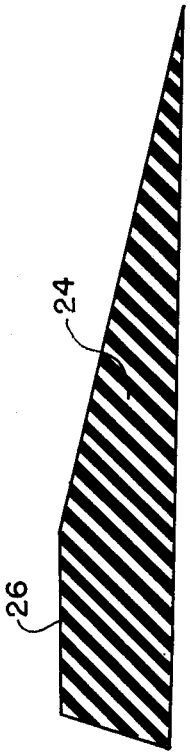
FIG. 4 (TRI-PLANE PAD) (POSTERIOR SECTION)
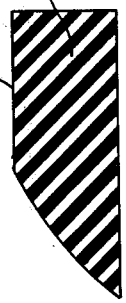

INSOLE AND OUTSOLE CONSTRUCTION FOR ATHLETIC (TENNIS) SHOES, AND THE LIKE

BACKGROUND OF THE INVENTION

Present day athletic (tennis) shoes, for the most part, do not provide adequate stability and protection for the foot and ankle of the wearer. This contributes to a high incidence of trauma. The currently used insole arch design provides a force which is insufficient to promote stability of the foot when the user is walking or running; and in some cases the insole arch design has been found to be actually detrimental to the protection of the foot and ankle during the more active athletic activities.

Most prior athletic (tennis) shoes become hot and uncomfortable during use since considerable heat and trauma are produced by the friction which occurs repeatedly as the feet move within the shoes. Friction is produced, for example, when the outsole of the shoe is abruptly stopped by the playing surface as inertia continues to move the foot forwardly in the shoe. Present day insoles are inefficient in preventing such forward motion of the foot, and no known lacing or design of the upper portion of the shoe can prevent the motion and resulting frictional heat.

The outsoles of prior athletic (tennis) shoes also have a common deficiency, and that is a lack of rigidity in the lateral aspect of the heel. During athletic activities, the heel of the shoe often comes into violent contact with the playing surface when the foot is in an inclined position. If the inclination of the foot is sufficient, the outside edge of the prior athletic (tennis) shoe has a tendency to collapse, so that the momentum of the body causes continued turning of the foot resulting in sprains or fractures.

The primary objective of the present invention is to provide a new insole and modified outsole for athletic shoes, and the like, by which the above-described inadequacies of the present day athletic shoes are overcome.

The insole construction of the invention, as mentioned briefly above, includes three separate pads which work together to promote greater stability of the foot within the shoe and to minimize the generation of frictional heat. These three pads consist of a tri-plane heel pad which creates a force against the plantar surface of the heel of the wearer simultaneously in all three body planes. This force prevents excessive pronation of the subtalar joint and excessive eversion of the calcaneus to enhance rear foot stability.

The prevention of excessive eversion of the calcaneus and excessive pronation of the subtalar joint also promotes forefoot stability. Forefoot instability is produced by excessive subtalar joint motion because pronation of the subtalar joint increases the total range of mid-tarsal joint motion. With the tri-plane heel pad of the present invention, stability of the forefoot is also enhanced, so that elongation of the foot is decreased, with a resulting decrease in friction and in the likelihood of sole or toe injury. Also, the use of the tri-plane pad of the invention results in the achievement of stabilization of the foot with a minimum of muscle activity, so that muscle fatigue is substantially decreased, as compared with the usual prior athletic shoe.

For a more complete discussion of the anatomy and mechanics of the foot, reference is made to "Biomechanical Examination of the Foot", Root, Orien, Weed, Clinical Biomechanics Corporation, Volume 1, published 1971, Library of Congress Catalog Card No. 71-185067.

The insole of the present invention also includes a lateral heel pad which assists the tri-plane pad in preventing eversion of the calcaneus. The force from this pad occurs primarily as the heel of the shoe meets the playing surface immediately prior to the transmission of the body weight into the tri-plane pad. The lateral heel pad also serves to reinforce the lateral heel area of the shoe.

The insole construction of the invention also includes a buttress pad which is constructed to assist in minimizing the movement of the forefoot, with a resulting minimizing in the generation of frictional heat, and a reduction in sole and toe injury. The buttress pad is located under the middle three toes in contact with the plantar (bottom surface of the toes. This increases the transmission of force into the toes producing greater propulsive stability and function of the toes. The buttress pad also provides a forward wall for the central three metatarsal heads of the foot, thus assisting in the prevention of anterior (forward) motion of the forefoot, and thereby reducing friction within the shoe and injury to the toes.

The outsole of the shoe may also be modified by the provision of inserts of relatively dense material on the medial (inside) and lateral (outside) heel area of the outsole of the shoe. The medial outsole insert is located directly below the tri-plane heel pad of the insole, and it serves to provide more efficient transmission of force into the tri-plane heel pad. The lateral outsole insert is located directly below the lateral heel pad. Its shape and location prevents collapse of the lateral area of the heel, which is a common cause of ankle injury in the use of the prior athletic (tennis) shoes.

BRIEF DESCRIPTION OF THE DRAWINGS

FIG. 3 is a medial section of the tri-plane pad taken along the line 3—3 of FIG. 2;

FIG. 4 is a posterior section of the tri-plane pad taken along the line 4—4 of FIG. 2;

FIG. 5 is a cross-section of the lateral heel pad taken along the line 5—5 of FIG. 2;

FIG. 6 is a posterior section of the buttress pad taken along the line 6—6 of FIG. 2; and FIG. 7 is a medial section of the buttress pad taken along the line 7—7 of FIG. 2.

DETAILED DESCRIPTION OF THE ILLUSTRATED EMBODIMENT

Figure 1:
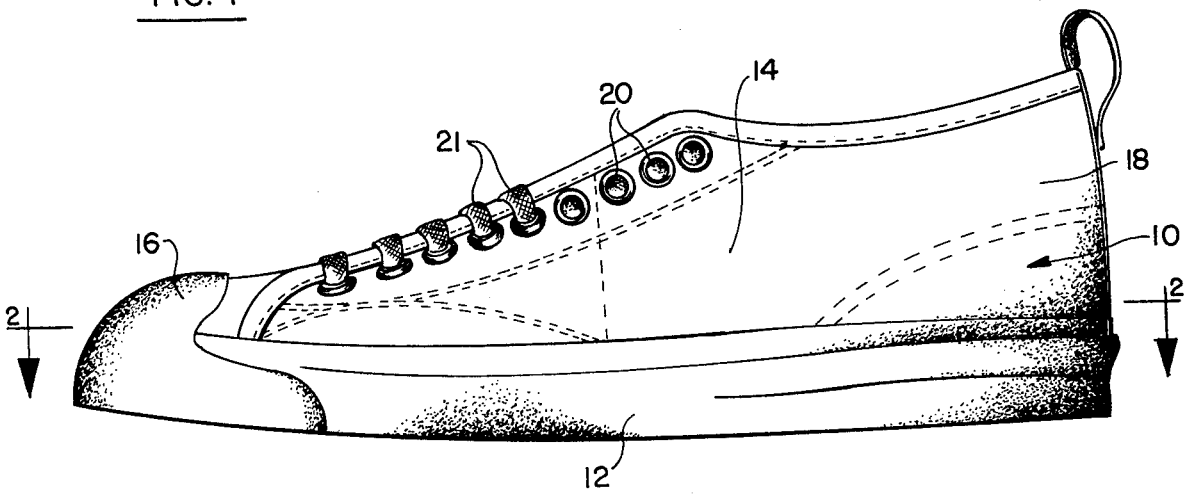
FIG. 1 is a side elevation of a typical tennis athletic shoe which may include the insole and outsole features of the present invention.

The athletic (tennis) shoe shown in FIG. 1 is designated generally as 10. At this point it should be pointed out that although the invention is particularly adapted for use in athletic tennis shoes, it has wider utility in various types of footwear. The athletic shoe 10 is formed of an outsole 12 of rubber or similar material, and an upper 14 which may be formed of canvas or other suitable material conventionally used in the fabrication of athletic shoes. A rubber toepiece 16 is formed on the shoe. The shoe is constructed with a relatively high rear quarter 18. The shoe is also provided with a tongue (not shown) and eyelets 20 through which a shoelace 21 may be threaded in usual manner.

Figure 2:
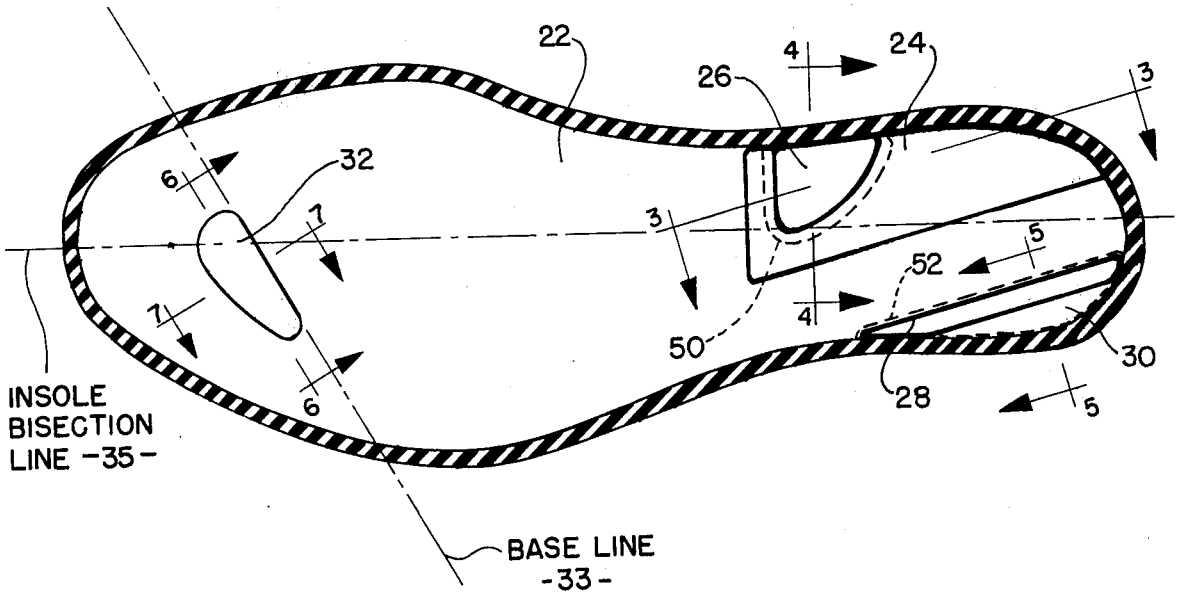
FIG. 2 is a section on an enlarged scale with respect to the elevation of FIG. 1, and taken essentially along the line 2—2 of FIG. 1, the section of FIG. 2 illustrating the tri-plane lateral and buttress pads of the insole of the present invention.

The insole of the shoe is designated 22, and as shown in FIG. 2. The insole would usually, in the case of canvas and leather type athletic shoes be an integral part of the shoe. However, the insoles may be formed separately, for example, for use with regular street shoes, and they then may be equipped with pressure-sensitive adhesive bottoms, to be inserted into such shoes. The insole pads and outsole corrections may also be incorporated into a one-piece insole and outsole combination.

The insole 22, as shown in FIG. 2 includes a tri-plane pad 24, which is located on the medial aspect of the heel of the shoe. The tri-plane pad is also shown in FIGS. 3 and 4. The tri-plane pad 24 is triangular in shape, and it is angulated to all three cardinal body planes. The base of the triangle forms the anterior (front) of the pad, and the apex of the triangle forms the posterior (back), as shown in FIG. 2. The pad has a tapered configuration upwardly from the plane of the insole with the most elevated area at the anterior medial corner, gradually sloping both interally and posteriorly down to feather edges.

In a constructed embodiment of the invention, the length of the dorsal surface of the tri-plane pad is substantially 30% of the overall insole length, and the width of the anterior edge of the pad is of the order of 55% of the width of the heel of the insole at the level of the posterior one-third of the total length of the insole. The lateral edge of the tri-plane pad is angulated substantially 15° from the sagittal bisection of the anterior aspect of the heel of the insole, the 15° angle running from the anterior lateral to the posterior medial. The posterior tip of the tri-plane pad is anterior to the most posterior point of the insole by approximately 4% of the total length of the insole, so that the posterior tip of the tri-plane pad does not contact the most posterior point of the insole. The foregoing are provided merely by way of example, and are not intended to limit the invention to any specific dimensions.

The medial edge of the tri-plane pad is contoured (curved), as illustrated, to correspond with the medial edge of the heel of the insole. This edge is gently beveled from anterior to posterior, and the anterior aspect of the beveling continues posteriorly to the apex, with the bevel gradually decreasing the thickness of the posterior surface of the pad.

A flat surface 26 is located on the anterior medial aspect of the tri-plane pad 24, and this surface will be referred to herein as the platform. The height of the platform may vary in men's, women's and children's shoes. In men's and women's shoes, for example, the uncompressed height of the platform may be of the order of 10–15 millimeters, and the compressed height is of the order of 7–12 millimeters. In children's shoes, the uncompressed height of the platform may be of the order of 5–10 millimeters, and the compressed height of the platform may be of the order of 3–8 millimeters. The width of the anterior edge of the platform may be approximately 55% of the width of the anterior edge of the tri-plane pad 24. The length of the medial edge of the platform may be of the order of 25% of the length of the medial edge of the tri-plane pad. The platform is contoured to correspond with the medial edge of the insole. The lateral and posterior edges of the platform describe a gentle arc from its anterior lateral corner to its posterior medial corner. Again, the various dimensions are provided hereby merely by way of example, and are not intended as limitations to the invention.

The posterior lateral surface of the tri-plane pad 24 is beveled from the arc that describes the lateral and posterior edges of the platform 26 to a feather edge on the lateral and posterior edge of the pad, as shown in FIGS. 3 and 4. The anterior surface of the tri-plane pad has a short sagittal plane bevel, which slightly increases the plantar length of the pad. This latter surface also has a frontal plane bevel from its thickest point to the anterior lateral corner of the platform to a feather edge of the anterior lateral edge of the tri-plane pad. The plantar surface of the tri-plane pad is flat, and is slightly longer than the dorsal surfce due to the bevel of the anterior surface of the pad.

The insole of FIG. 2 also includes a lateral heel pad 28 which is located in the posterior lateral aspect of the heel. The lateral heel pad has a generally truncated triangular section, as best shown in FIG. 5, to define an elevated elongated platform 30. The inner lateral edge of the lateral heel pad is angulated 15° from the sagittal bisection of the posterior aspect of the heel, with the 15° angle running from posterior medial to anterior lateral. The inner lateral edge of the lateral heel pad is generally parallel to the lateral edge of the tri-plane pad 24. The lateral edge of the lateral heel pad confirms to the curvature of the lateral aspect of the heel of the insole. The height of the lateral pad will vary slightly between men's and women's shoes and may be reduced significantly in children's shoes.

The uncompressed height of the lateral heel pad may be of the order of 4–8 millimeters, and the compressed height of the pad may be of the order of 3–7 millimeters. The length of the lateral heel pad may be of the order of 15% of the total length of the insole. The posterior corner of the lateral heel pad may be 2% of the total insole length from the posterior tip of the insole. The medial surface of the lateral heel pad has a short bevel from the medial edge of the platform 30 on the top surface of the pad to the medial edge of the pad. The width of the lateral heel pad at its widest point is preferably about 10% of the width of the heel of the insole. The widest point of the lateral pad is approximately at the center of the length of the pad. The platform 30 of the lateral pad is a flat surface, and it represents the lateral one-half of the pad. The width of the platform is one-half of the width of the lateral pad.

As in the case of the tri-plane pad, the foregoing dimensions are provided merely by way of explanation, and are not intended to limit the invention in any way.

The insole of FIG. 2 also includes a buttress pad 32 which is a dome-shaped pad located under the approximate position of the sulcus of the second, third and fourth toes of the wearer's foot. The material of the buttress pad may vary in density, but it preferably consists of a self-molding material which will conform to individual irregularities of the toes and foot. The insole 22 and the pads 24, 28 and 32 may have an integral construction, and they are formed of rubber, or appropriate rubber-like material.

The height of the buttress pad 32 at its highest point may range between 5–15 millimeters, depending on the density of the material used, and the upper surface of the pad tapers in all directions from that point, as shown in FIGS. 6 and 7. In the illustrated embodiment, the major axis of the buttress pad (base line) forms an angle with the heel bisection line of the shoe of approximately 112°. The sagittal length at the center of the buttress pad 32 may vary between 8 and 15 millimeters, or approximately 4% to 8% of the overall insole length. The frontal width at the base line 33 of the buttress pad may be approximately 25–45 millimeters, or 50% of the width of the insole along the base line of the insole. The medial edge of the buttress pad 32 in the illustrated embodiment starts at approximately 30% of the total insole width from the medial width of the insole to the base line 33. The lateral edge of the buttress pad starts approximately 20% of the total insole width from the lateral edge of the insole on the base line. The posterior edge of the buttress pad, base line, starts at approximately 85% of the insole bisection line, as shown in FIG. 2, as 35.

Again, the foregoing dimensions are provided merely by way of explanation and are not intended to limit the invention in any way.

The invention provides, therefore, for an athletic shoe, or any shoe, an insole which is constructed to reduce injury to the foot and ankle, to promote foot stability of minimizing excessive pronation, which serves to minimize elongation and friction to the sole of the forefoot, and which also serves to minimize sliding and injury to the toes. The improved insole construction of the invention also serves to reduce abnormal shoe wear and to reduce muscle fatigue.

The outsole of the shoe also includes an insert 50, represented by the broken line in FIG. 2, directly under the tri-plane pad 24; and it includes an insert 52, represented by the broken lines in FIG. 2, directly under the lateral heel pad 30. The inserts 50 and 52 are formed of relatively dense rubber-like material, as compared with the material constituting the outsole itself. As explained above, the insert 50 provides more efficient transmission of force into the tri-plane heel pad 24; whereas the shape and location of the insert 52 prevents collapse of the lateral area of the heel, which is a common cause of ankle injury.

The insole construction and outsole modifications described above are intended primarily for canvas and leather-type athletic shoes. However, other applications are possible in regular street shoes, or as separate insoles with pressure-sensitive adhesive bottoms to be used independently in previously purchased street or athletic shoes.

Insoles having different densities of the tri-plane pad may be produced to provide strong, moderate or weak forces so the wearer can evaluate for himself the insole which is the most comfortable and effective. The individual foot structure and function and anticipated activity will influence the choice of the insole.

It will be appreciated that although three different types of pads, namely the tri-plane pad 24, the lateral heel pad 28, and the buttress pad 32 are all shown in the illustrated embodiment of the invention, the pads may be used individually in certain shoes, or in pairs, as desired.

Therefore, although a particular embodiment of the invention has been shown and described, modifications may be made. It is intended in the claims to cover the modifications which come within the spirit and scope of the invention.

What is claimed is:

1. In an athletic shoe, or the like, having an outsole and an insole, and further having an upper extending from the outsole over and enclosing the insole; a tri-plane heel pad positioned on said insole at the medial aspect of the heel of the shoe to create a force against the plantar surface of the heel of the wearer simultaneously in all three body planes to prevent excessive subtalar joint pronation and elongation of the foot; and an elongated lateral heel pad positioned on said insole in the posterior lateral aspect of the heel of the shoe and displaced laterally from said tri-plane heel pad and essentially parallel to the medial edge thereof to assist said tri-plane heel pad in limiting the amount of eversion of the calcaneus and to reinforce the lateral heel area of the shoe.

2. The combination defined in claim 1, and which includes an elongated dome-shaped buttress pad positioned on said insole under the middle three toes of the wearer to provide a transverse wall for the central three metatarsal heads of the foot of the wearer to restrict anterior movement of the forefoot.

3. In an athletic shoe, or the like, having an outsole and an insole, and further having an upper extending from the outsole over and enclosing the insole; a tri-plane heel pad positioned on said insole at the medial aspect of the heel of the shoe to create a force against the plantar surface of the heel of the wearer simultaneously in all three body planes to limit excessive subtalar joint pronation and elongation of the foot, and which includes a medial insert positioned on the outsole directly under the tri-plane heel pad and of a denser material than the material of the outsole to provide an efficient transmission of force to the tri-plane heel pad.

4. The combination defined in claim 1, and which includes a lateral insert of a denser material than the material of the outsole and positioned in the outsole directly under the lateral heel pad to retard collapse of the lateral area of the heel of the shoe.

5. In an athletic shoe, or the like, having an outsole and an insole, and further having an upper extending from the outsole over and enclosing the insole; a tri-plane heel pad positioned on said insole at the medial aspect of the heel of the shoe to create a force against the plantar surface of the heel of the wearer simultaneously in all three body planes to limit excessive subtalar joint pronation and elongation of the foot, in which said tri-plane pad is triangular in shape and is angulated in all three cardinal body planes with the anterior of the pad forming the base of the triangle and with the posterior of the pad forming the apex, the pad being tapered to have its thickest area at the anterior medial corner and tapering laterally and posteriorly to feather edges at the lateral and posterior borders, said tri-plane pad having an elevated flat surface located on its anterior medial aspect to define a platform.

6. The combination defined in claim 1, in which said lateral heel pad has a truncated solid triangular shape to define an elevated flat elongated platform.

7. The combination defined in claim 2, in which said buttress pad has a dome shape and is located under the approximate position of the sulcus of the second, third and fourth toes of the wearer, and has a base line extending transversely to the bisection line of the insole at a predetermined inclination thereto.

8. In an athletic shoe, or the like, having an outsole and an insole, and further having an upper extending from the outsole over and enclosing the insole; an elongated lateral heel pad having a generally truncated triangular section to define an elevated elongated platform positioned on said insole in the posterior lateral aspect of the heel of the shoe to limit eversion of the calcaneus and to reinforce the lateral heel area of the shoe the inner edge of the lateral heel pad being angulated approximately 15° from the sagittal bisection of the posterior of the heel of the shoe.

9. In an athletic shoe, or the like, having an outsole and an insole and further having an upper extending from the outsole over and enclosing the insole; an elongated dome-shaped buttress pad positioned on said insole under the middle three toes of the wearer to provide a transverse wall for the central three metatarsal heads of the foot of the wearer to restrict anterior movement of the forefoot, the major axis of the buttress pad forming an angle with the heel bisection line of the shoe of approximately 112°.

* * * * *